US006585495B2

(12) United States Patent
Thomas

(10) Patent No.: US 6,585,495 B2
(45) Date of Patent: Jul. 1, 2003

(54) REVERSIBLE VOLUME OIL IMPELLER PUMP WITH MECHANICAL GOVERNOR

(75) Inventor: James A. Thomas, Ft. Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/167,205

(22) Filed: Jun. 11, 2002

(65) Prior Publication Data

US 2002/0150482 A1 Oct. 17, 2002

Related U.S. Application Data

(62) Division of application No. 09/795,529, filed on Feb. 27, 2001, now Pat. No. 6,461,117.

(51) Int. Cl.[7] ..... F04B 17/00

(52) U.S. Cl. ..... 417/379; 417/244; 417/293; 417/510; 251/248; 137/565.17

(58) Field of Search ..... 417/244, 279, 417/293, 299, 379, 470, 490, 510; 251/248, 279; 137/565.17, 565.37

(56) References Cited

U.S. PATENT DOCUMENTS

| | | | | | |
|---|---|---|---|---|---|
| 2,782,595 | A | * | 2/1957 | Pauly | 60/39.281 |
| 3,135,087 | A | * | 6/1964 | Ebert | 60/464 |
| 3,380,248 | A | * | 4/1968 | D'Amato | 60/460 |
| 3,439,662 | A | * | 4/1969 | Jones et al. | 123/321 |
| 3,749,531 | A | * | 7/1973 | Walker et al. | 418/45 |
| 3,918,828 | A | * | 11/1975 | Kumm | 415/61 |
| 5,823,091 | A | * | 10/1998 | Collingborn | 92/59 |

* cited by examiner

*Primary Examiner*—Charles G. Freay
*Assistant Examiner*—John F Belena
(74) *Attorney, Agent, or Firm*—Jeffrey P. Calfa; Neil T. Powell; Dennis Kelly Sullivan

(57) ABSTRACT

A fluid pump is provided that produces an outflow of fluid that is not proportional to the speed of the input drive. Thus, the fluid pump can be tuned to provide a substantially constant outflow of fluid irrespective of the speed of the input drive. The fluid pump also provides fluid outflow when the rotational direction of the input drive is reversed.

26 Claims, 3 Drawing Sheets

REVERSIBLE VOLUME OIL IMPELLER PUMP WITH MECHANICAL GOVERNOR

This is a division of application Ser. No. 09/795,529, filed Feb. 27, 2001, now U.S. Pat. No. 6,461,117.

FIELD OF THE INVENTION

The present invention relates generally to fluid pumps, and particularly, to a lubrication pump capable of providing a substantially constant outflow of fluid.

BACKGROUND

As is well-known to those skilled in the art of automotive vehicle, but also known by those in other arts, mechanical assemblies often require fluid lubrication for optimal performance and reliability. Typical examples where this need for lubrication is especially important in automotive vehicles include piston engines, transmissions, and other drivetrain components. Commonly, lubrication is provided to these components with a fluid pump that produces an outflow of fluid from a fluid reservoir. The outflow of fluid is then directed throughout the component that requires lubrication by a number of narrow passages or hoses.

To optimize lubrication, the fluid is often routed directly to critical friction surfaces within the component. Typically, these critical friction surfaces involve mating metal surfaces that slide against each other under high speed or high load. A common example of a critical friction surface that requires lubrication is the journal and bearing surface of a rotating bearing. Lubrication of moving parts generally provides two benefits. First, the fluid minimizes wear between the moving parts, thus lengthening the operating life of the component and also increasing efficiency of the component. Second, the fluid absorbs heat that is generated by the friction between the moving parts, thus dissipating the heat away from the moving parts and cooling the component. As is well-known by those in the art, a variety of fluids can be used to lubricate critical friction surfaces, and the choice is usually influenced by a number of different design considerations. Petrochemical oils with varying viscosities are commonly used for lubrication and are satisfactory for many applications. One example of a well-known and often used lubricant is automatic transmission fluid, or also referred to as Dextron II.

Traditionally, lubrication of automotive vehicle components has been provided by mechanically driven fluid pumps. Accordingly, the fluid pump is usually mounted directly to or close by the drivetrain component, and power is provided to the pump from rotating drive members in the component. A variety of drive systems have been employed to power lubrication fluid pumps, with one common example including an input drive shaft that extends into the fluid pump and a gear from the drivetrain component that drives the input drive shaft.

One characteristic of mechanically driven fluid pumps is that the volume of fluid outflow from the pump usually varies as the speed of the input drive shaft varies. Thus, as the speed of the drive gear from the component increases (and consequently the speed of the input drive shaft increases), the volume of fluid flowing from the pump will increase. Similarly, as the speed of the component decreases, the outflow from the pump also decreases. Thus, a proportional relationship generally exists between the speed of the component and the outflow of fluid from the pump.

Usually, this variation in outflow from the pump does not present any significant problems to the performance of an automotive vehicle. Typically, the engine in an automotive vehicle operates within a relatively narrow range of rotational speeds. Thus, the maximum speed of the engine is often about 3,000 rpm and the slowest speed of the engine is about 500 rpm when the engine is idling. The rotational speed of the drivetrain components are likewise relatively narrow. Therefore, because the speed of the input drive shaft for the fluid pump varies within a relatively narrow range, the resulting variation in lubricating fluid flow is also minimal. This limited variation in lubricating fluid flow generally has few adverse effects on the drivetrain components because a range of flow volume is acceptable.

However in some lubricating systems, a proportional relationship between component speed and pump outflow is unsatisfactory. One such example involves electric motor driven drivetrains. In these systems the electric motor can operate at much faster speeds than traditional drivetrain components. In addition, the electric motor can operate at very low speeds below the traditional 500 rpm idling speed, including speeds nearing zero rpm. In these types of drivetrains, the normal variation in outflow from a traditional fluid pump is too large to provide acceptable lubrication of the drivetrain components. The problem is especially acute at low speeds, where the outflow of fluid from a traditional pump is reduced significantly and approaches zero as the electric motor nears zero rpm. In contrast, the electric motor in these systems tends to operate at its worst efficiency and generates the most heat at low speeds. Thus, in drivetrains where the fluid pump is used to lubricate and cool the electric motor in addition to other drivetrain components, a traditional fluid pump is inadequate to provide acceptable fluid flow.

Another problem with mechanically driven fluid pumps is the inability to provide fluid outflow when the rotational direction of the input drive shaft reverses. This is generally not a problem with piston engine drivetrains because the major drivetrain components always rotate in the same direction and never reverse their direction of rotation. However, when an electric motor is used in the drivetrain, the rotational direction of the drivetrain components can easily be reversed by simply switching the direction of rotation of the electric motor through its logic controller. Thus, traditional fluid pumps are also inadequate for electric motor drivetrains because they do not provide lubrication fluid when the electric motor reverses direction.

One alternative to a traditional mechanically driven fluid pump is an electric powered fluid pump. In this alternative, the electrical system of the automotive vehicle supplies power to the fluid pump. The pump and the resulting outflow of fluid can then be controlled by a logic controller. Thus, the fluid outflow can be controlled irrespective of the speed or direction of rotation of the drivetrain. Accordingly, the volume of fluid outflow from the pump can be maintained at a substantially constant volume throughout the entire range of drivetrain component speeds. The electric pump is also unaffected by the rotational direction of the drivetrain, and thus lubrication fluid can be provided when the drivetrain is operated in a reverse direction.

Several problems exist with electric pumps however. Electric pumps generally operate less efficiently than mechanically driven fluid pumps. For example, in mechanically driven pumps the drive system is often about 96% efficient in providing power to the pumping assembly. On the other hand, an electric drive system is usually only about 80% efficient in providing power to the pumping assembly. Electric pumps are also usually less reliable than mechanically driven pumps during the operating life of the automotive vehicle. This lower reliability typically occurs because electric pumps are more complicated, thus providing more potential sources of failures. Electric pumps are also the source of more failures because the electric pump is usually mounted to the chassis of the automotive vehicle and is connected to the drivetrain components with fluid hoses and electrical wiring. As a result, these extra hoses and wires become susceptible to damage from being town, worn or cut. In contrast, mechanically driven pumps are often designed to be integral with a drivetrain component, making excess hoses and wires unnecessary. In addition, another problem with electric pumps is the difficulty of designing an electric pump into the electrical system of an automotive vehicle. Typically, automotive vehicles are provided with a 12V electrical system to power a variety of accessories. If an electric motor drivetrain is used in the automotive vehicle, another higher voltage electrical system may be provided for the electric motor. However, the electric pump is not always easily designed into either of these electrical systems because of load and efficiency considerations. One final problem with electric pumps is their cost, which is usually higher in automotive vehicles than mechanical pumps. As is well-known, automotive vehicles are typically produced by manufacturers in high volumes. As a result, mechanically driven pumps are usually less expensive since the capital cost of designing a specially adapted pump can be averaged across a large number of vehicles.

SUMMARY

Accordingly, a mechanically driven fluid pump is provided for producing a fluid outflow that is not proportional to the speed of the input drive. The pump includes a control valve that directs some of the fluid from the pump assembly to an outflow port and some of the fluid to a diversion port. As the speed of the input drive charges, the position of the valve is altered, thus altering the proportion of fluid directed to the outflow and diversion ports. A mechanical governor that applies centrifugal force to swing arms can be used to alter the position of the control valve proportionately to the speed of the input drive.

Two embodiments of a pump assembly are provided with both embodiments capable of producing fluid flow when the rotational direction of the input drive is reversed. One embodiment is an impeller pump assembly that includes an impeller with forward and reverse impeller sections. When the input drive rotates, one of the impeller sections is sealed by a dividing plate, thus producing fluid flow from one of the impeller sections. Another embodiment is a cam piston pump assembly. The cam piston pump assembly includes a cam attached to the input shaft and a pushrod biased against the cam. The pushrod reciprocates a piston which forces fluid through a control valve.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
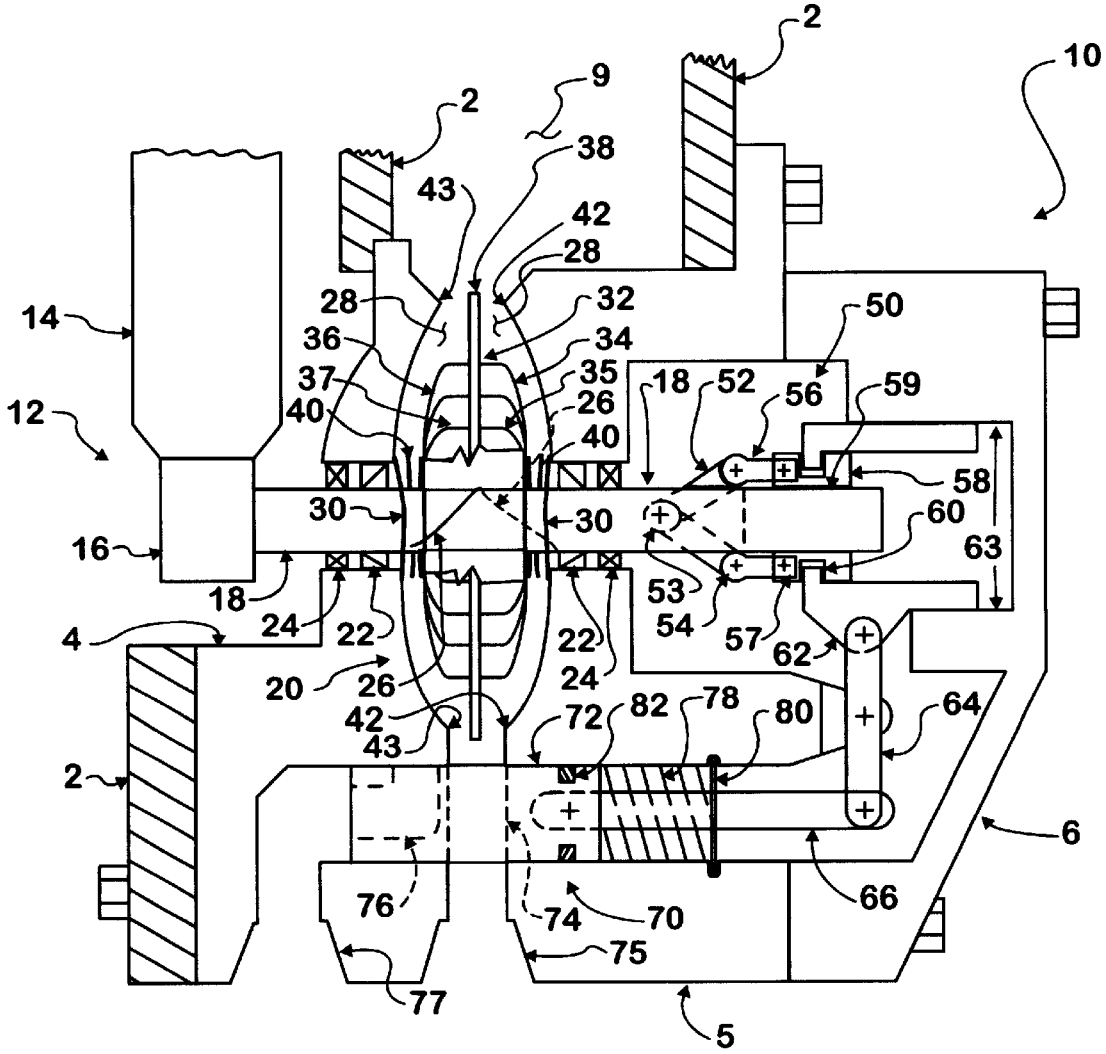
FIG. 1 is a cross-sectional view of an impeller pump, showing an input drive, an impeller pump assembly, a governor and a control valve.

Referring now to the drawings, two embodiments are provided of a fluid pump 10,100 for lubricating drivetrain components 2 in automotive vehicles or other such applications. The first embodiment, shown in FIG. 1, employs an impeller pump assembly 20 to provide fluid flow through the pump 10. In comparison, the second embodiment, shown in FIG. 2, employs a cam piston pump assembly 110 to provide the fluid flow. Both pumps 10,100 are capable of providing a substantially constant outflow of fluid from the pump 10,100 irrespective of variations in the speed of the input drive 12. Additionally, the pumps 10,100 can provide fluid outflow when the input drive 12 is rotated in either a forward or reverse direction. Thus, the first and second embodiments demonstrate a wide breadth of the present invention.

Turning to FIG. 1, the impeller pump 10 includes an input drive 12. Various input drives are possible, but the preferred embodiment uses a drive gear 14, a driven gear 16, and an input shaft 18. Preferably, the drive gear 14 is a power transmission gear that is integral with the drivetrain component 2 that is lubricated by the pump 10. Typically, the rotational speed of the drive gear 14 will vary within a range as the speed of the drivetrain component 2 varies. These speed variations may include speeds approaching zero rpm. The drive gear 14 may also rotate in either a forward direction or a reverse direction (i.e. clockwise or counterclockwise). In some applications the drive gear 14 is connected either directly or indirectly to an electric drive motor, thus making large variations in rotational speed possible and making reversals in the rotational direction likely. The gear teeth of the drive gear 14 enmesh with the gear teeth of the driven gear 16 so that when the drive gear 14 rotates, the driven gear 16 rotates responsively. The input shaft 18 is fixedly attached to the driven gear 16 so that it also rotates responsively as the driven gear 16 rotates.

The input shaft 18 extends into the pump 10 and through the impeller pump assembly 20 and the mechanical governor assembly 50. The input shaft 18 is rotationally mounted within the housing assembly 4, 5 by tapered roller bearings 22. Thus, one tapered roller bearing 22 is mounted on one side of the pump assembly 20 and another tapered roller bearing 22 is mounted on the other side of the pump assembly 20. The tapered roller bearings 22 are matched and appropriately mounted to resist thrust forces that are generated by the impeller pump assembly 20. The fluid in the pump assembly 20 is sealed from the input drive 12 and the governor assembly 50 by seals 24 that are mounted onto the input shaft 18 adjacent to the outside of each of the tapered roller bearings 22. Therefore, the tapered roller bearings 22 are lubricated by the fluid that flows through the pump assembly 20. The drive gear 14 and driven gear 16 are also preferably lubricated with a fluid, but the seal 24 between the pump assembly 20 and the input drive 12 allows a different type of fluid to be used if so desired. The governor assembly 50 is also preferably lubricated. However, a grease-type lubricant is preferable and can be applied a single time during assembly of the pump 20. The seal 24 between the pump assembly 20 and the governor assembly 50 prevents fluid from entering the governor assembly 50.

The input shaft 18 also includes a long-pitch thread section 26 that is positioned across the length of the pump cavity 28. Various thread designs are possible but a thread 26 with about one thread revolution per inch is preferable. The thread 26 is illustrated in FIG. 1 as a hidden, helical line on the input shaft 18. A pair of snap rings 30 are also mounted onto the input shaft, with one snap ring 30 positioned on each side of the impeller 32. The snap rings 30 are positioned so that the inside surfaces of the snap rings 30 are located slightly within the pump cavity 28. Accordingly, the snap rings 30 stop the movement of the impeller 32 as it travels along the thread 26 when one side of the impeller 32 abuts against either of the snap rings 30. However, many other types of stops may also be used to limit the travel of the impeller 32.

Preferably, the impeller 32 is a single piece unit and may be made from die cast aluminum. The impeller 32 includes a forward impeller section 34 and a reverse impeller section 36. Accordingly, the forward impeller section 34 has impeller blades 35 facing in one direction, and the reverse impeller section 36 has impeller blades 37 facing in the opposite direction. The two impeller sections 34, 36 are separated by a dividing plate 38 that blocks fluid flow between the impeller blades 35, 37 of the two sections 34, 36. The dividing plate 38 also extends outward from the outer diameter of the impeller sections 34, 36.

The impeller 32 also includes an inner bore (not indicated) that extends through the impeller 32. The diameter of the inner bore mates with the diameter of the input shaft 18 so that the impeller 32 readily slides laterally along the input shaft 18. The inner bore also includes a mating thread 26 to the long-pitch thread 26 of the input shaft 18. Accordingly, the impeller 32 is threaded onto the thread 26 of the input shaft 18, thus allowing the impeller 32 to move laterally along the input shaft 18 as the impeller 32 rotates about the long-pitch threads 26. Matching springs 40 are provided to counter this movement of the impeller 32. One of the springs 40 is mounted between each side of the impeller 32 and the corresponding side of the pump housing 4, 5. Accordingly, each of the springs 40 apply a force against opposite sides of the impeller 32 and against each other 40, thereby centering the impeller 32 within the pump cavity 28.

The operation of the impeller pump assembly 20 is now apparent. When the drive gear 14 is not moving and the pump 10 is at rest, the impeller 32 is forced to the center of the pump cavity 28 by the springs 40. However, when the drive gear 14 begins to rotate in a forward direction, inertia and resistance from the fluid on the impeller blades 35, 37 cause the impeller 32 to rotate, or spin, on the input shaft 18. As the impeller 32 rotates on the input shaft 18, the impeller 32 overcomes the small bias provided by the springs 40 and travels along the long pitch threads 26 toward the reverse side sealing surfaces 43. The movement of the impeller 32 is stopped by one of the snap rings 30 when the dividing plate 38 is positioned near to but not touching the reverse side sealing surfaces 43. The reverse impeller section 36 is now almost 100% sealed from the reservoir 9 and the control valve 70, thus preventing the reverse facing impeller blades 37 from pumping fluid. Accordingly, the forward facing impeller blades 35 pump fluid through the pump assembly 20 from the reservoir 9 to the control valve 70. Similarly, when the drive gear 14 begins to rotate in the reverse direction, an opposite sequence of events occurs. Instead of traveling toward the reverse sealing surfaces 43, the impeller 32 follows the long-pitch threads 26 toward the forward sealing surfaces 42 until the impeller 32 abuts and stops against the other snap ring 30, thus sealing almost 100% the forward impeller section 34. Because the reverse impeller blades 37 face in the opposite direction of the forward impeller blades 35, the reverse impeller section 36 pumps fluid through the pump assembly 20 while the input shaft 18 rotates in reverse. Thus, regardless of the direction of rotation of the drive gear 14, the impeller 32 provides fluid flow through the pump 10.

The volume of fluid flow through the pump assembly 10, however, is generally proportional to the speed of drive gear 14. Therefore, a mechanical governor assembly 50 and a control valve 70 are provided to reduce the variation of fluid flow volume through the pump assembly 20. The governor 50 includes a pair of first swing arms 52 that are pivotally attached at a first end 53 to the input shaft 18. The second end 54 of the first swing arms 52 is pivotally attached to a second end 54 of a second pair of swing arms 56. The second swing arm 56 is then pivotally attached at a first end 57 to a sleeve 58. The sleeve 58 includes an inner bore 59 that is sized to easily slide along the input shaft 18. The sleeve 58 also includes a slot 60 along the exterior of the sleeve 58. A piston 62, or drive member 62, is installed within the slot 60 and is installed within a guide diameter 63 in the pump housing 6. The piston 62 is also pivotally connected to one end of a lever 64. The other end of the lever 64 is pivotally connected to a pushrod 66, and a midpoint of the lever 64 is pivotally attached to the pump housing 5.

The pushrod 66 is pivotally connected to the spool 72 of the control valve 70. The spool 72 includes two passages 74, 76 that extend through the spool 72. One passage is an outflow passage 74 that is straight and connects the pump assembly 20 to the outflow port 75 of the pump 10. The other passage is a diversion passage 76 that is angled and connects the pump assembly 20 to the diversion outflow port 77. The control valve 70 also includes a spring 78 that is retained between the spool 72 and a snap ring 80 attached to the pump housing 5. Thus, the spring 78 forces the spool 72 away from the snap ring 80. An O-ring seal 82 is also provided which prevents fluid from leaking through the control valve 70 and entering the governor 50.

Accordingly, the manner in which the governor 50 and the control valve 70 compensate for the variable fluid flow through the pump assembly 20 is now apparent. When the drive gear 14 is not moving and the pump 10 is at rest, the spring 78 in the control valve 70 biases the spool 72 so that the entire outflow passage 74 connects the pump assembly 20 to the outflow port 75. At this stage, the diversion passage 76 is biased away from the pump assembly 20, thus preventing fluid from flowing to the diversion outflow port 77.

However, when the drive gear 14 begins to rotate, centrifugal force is generated and applied to the swing arms 52, 56, which pulls the second ends 54 of the swing arms 52, 56 outward. As the swing arms 52, 56 are forced outward, the swing arms 52, 56 pull the sleeve 58 toward the first end 53 of the first swing arms 52. Correspondingly, the piston 62 also moves towards the first end 53 of the first swing arms 52, and the lever 64 rotates about its midpoint. The spool 72 is then forced against the spring 78 so that the diversion passage 76 moves toward the pump assembly 20.

As is readily understood, an increasing amount of centrifugal force is applied to the swing arms 52, 56 as the speed of the dive gear 14 increases, thus causing the spool 72 to move the diversion passage 76 proportionately further toward the pump assembly 20. The outflow passage 74 and the diversion passage 76 are positioned sufficiently close to each other so that when the drive gear 14 reaches a particular speed, the pump assembly 20 will be connected to both passages 74, 76 simultaneously. Therefore, some of the fluid flow will pass to the outflow port 75 and some of the fluid flow will pass to the diversion outflow port 77. As the speed of the driving gear 14 increases, the diversion passage 76 becomes increasingly more connected to the pump assembly 20. As a result, the control valve 70 progressively provides less fluid flow to the outflow port 75 and more fluid to the diversion outflow port 77.

By tuning the governor assembly 50 and the control valve 70, the desired volume of fluid outflow from the pump 10 can be achieved. Preferably, the desired outflow will be substantially constant irrespective of the speed of the drive gear 14. Tuning will generally involve adjustments to the size and spacing of the passages 74, 76 in the spool 72 and the inertia of the swing arms 52, 56. Additionally, a pressure-regulating device (not shown) such as an orifice or valve, may be desirable in the diversion outflow port 77 to adjust the fluid pressure that is provided to the outflow port 75. These tunings and others that may be necessary are all within the normal skill of those in the art and will depend on the particular application of the pump 10 and the desired fluid flow characteristics.

Preferably, the pump 10 is designed to be an integral assembly with the drivetrain component 2 that requires lubrication. Thus, the pump 10 can be directly mounted to the component 2. Instead of an outflow port 75, the outflow port 75 may also be a series of internal passages that directly connect the outflowing fluid to the desired lubricating areas. Likewise, the diversion outflow port 77 may be a series of internal passages that eventually return the fluid to the reservoir 9. However, the outflow port 75 is preferably connected to a heat exchanger that cools the fluid before returning the fluid to the reservoir 9. To ease assembly of the pump 10, the pump housings 4, 5, 6 may also include multiple housings that are connected together during assembly of the pump 10. Thus, in the desired embodiment, three housing 4, 5, 6 are employed.

Figure 2:
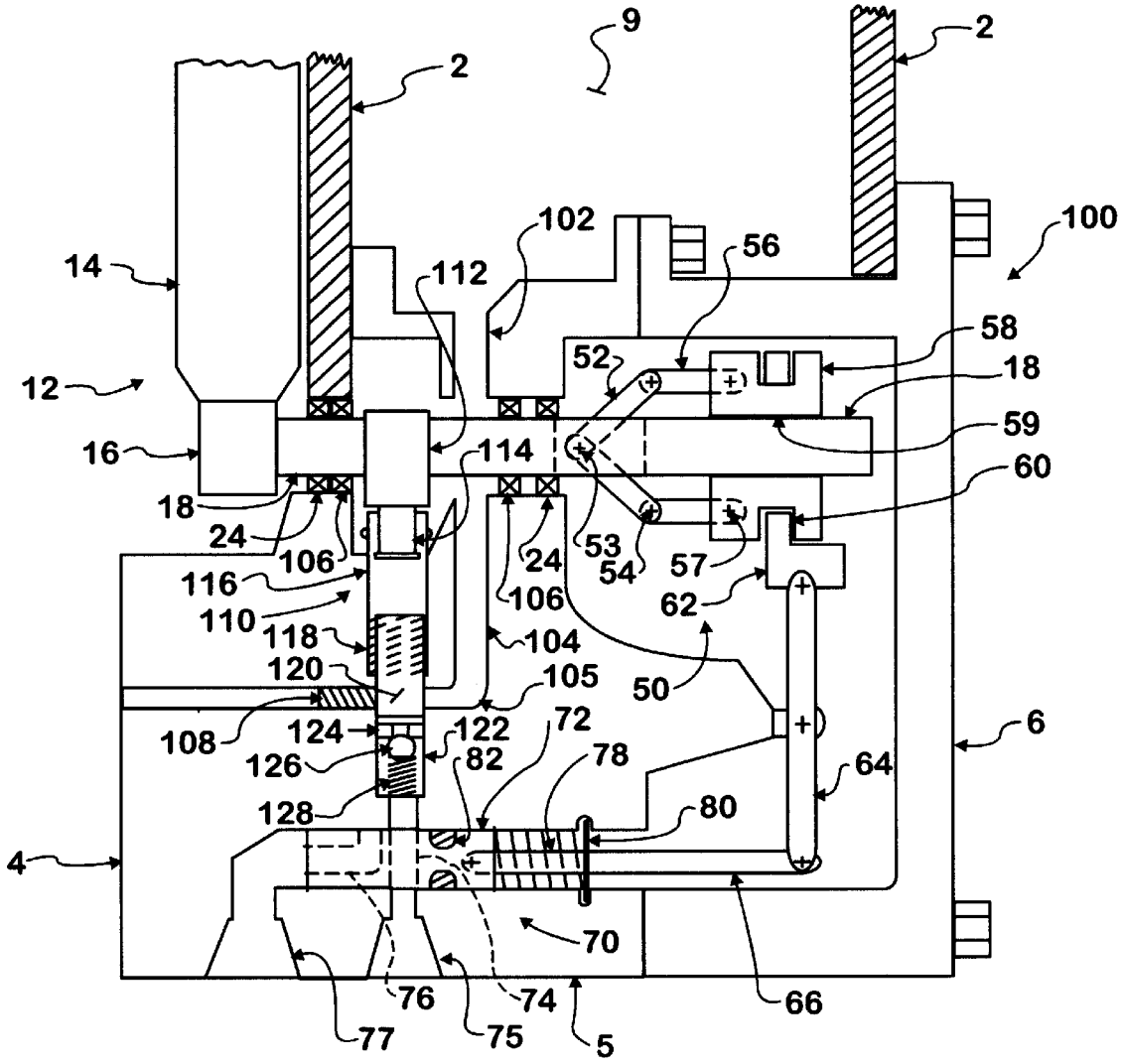
FIG. 2 is a cross-sectional view of a cam piston pump, showing an input drive, a cam piston pump assembly, a governor and a control valve.
Figure 4:
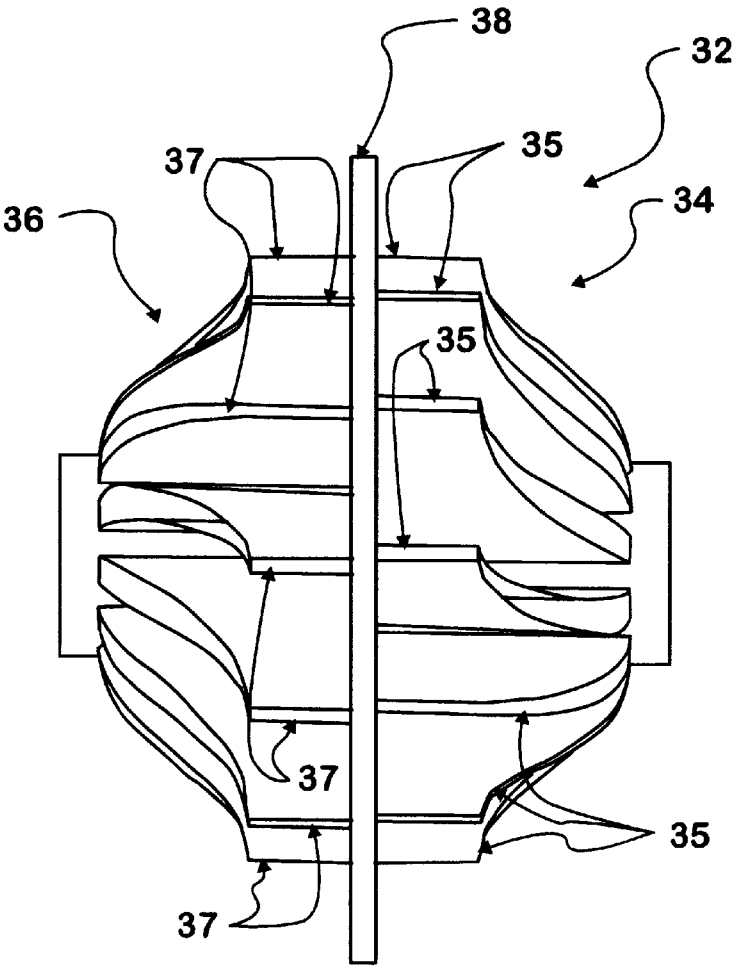
FIG. 4 is an elevational side view of the impeller.
Figure 3:
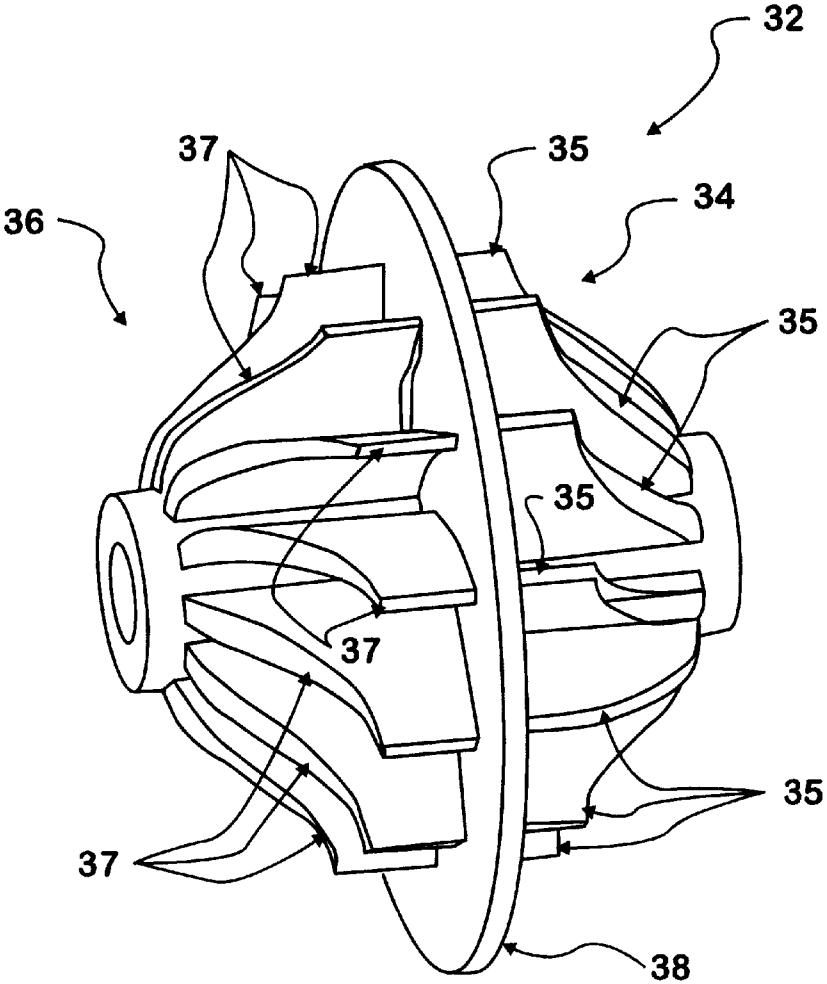
FIG. 3 is a perspective view of an impeller.

Turning now to FIG. 2 and the second embodiment, a fluid pump 100 with a cam piston pump assembly 110 is provided. The cam piston pump 100 is similar to the impeller pump 10 described above; therefore the input drive 12, governor assembly 50 and control valve 70 do not need to be described further since their functions are generally the same as in the impeller pump 10. In the cam piston pump 100, the pump assembly 110, which was represented by the impeller pump assembly 20 in the impeller pump 10, includes a cam 112 and a piston 120.

Accordingly, a cam 112 is fixedly attached to the input shaft 18. The cam contacts a roller 114 that is pivotally attached to a pushrod 116. The pushrod 116 is installed in a bore (not indicated) that allows the pushrod 116 to freely move up and down. However, a spring 118 is installed below the pushrod 116 to bias the pushrod 116 and roller 114 against the cam 112. The pushrod 116 also includes a piston 120 at the bottom end of the pushrod 116.

Fluid is routed from the reservoir 9 to the piston 120 through internal passages 102, 104. Preferably, the first passage 102 is connected to the pump assembly 110 to provide lubrication to the cam 112 and pushrod 116. As with the impeller pump 10, seals 24 are preferably provided on the outside of the bearings 106 to prevent fluid from entering the governor 50 and the input drive 12. Unlike the impeller pump 10, the bearings 106 may be roller ball bearings 106 instead of tapered roller bearings 22 since little thrust is expected from the pump assembly 20. However, tapered roller bearings can be used in a particular application if the thrust generated by the governor 50 exceeds the capacity of the roller ball bearings 106.

The fluid proceeds through a second passage 104 to the piston 120. For manufacturing purposes, the lower portion 105 of the second passage 104 is drilled through the side of the pump housing 4, 5. Therefore, a plug 108 is installed into the outside portion of the passage 104 to block the end of the second passage 104. Installed below the piston 120 is a check valve 122. The check valve 122 includes an orifice 124 and a ball 126 that is forced against the orifice 124 by a spring 128.

Accordingly, the operation of the cam piston pump 100 is now apparent. As the input shaft 18 rotates, the cam 112 alternately forces the pushrod 116 down, with the spring 118 biasing the pushrod up, so that the piston 120 reciprocates between up and down positions. As a result, when the push rod 116 is in its upward position, the piston 120 is positioned above the lower portion 105 of the second passage 104. Fluid then fills the entire lower portion 105 of the passage 104. However, when the pushrod 116 moves to its downward position, the piston 120 travels through lower portion 105 of the passage 104, thereby forcing fluid down into the check valve 122. The fluid then passes through the orifice 124 and forces the ball 126 down against the spring 128, thus allowing the fluid to pass to the control valve 70. Once the fluid passes through the check valve 122, the piston 120 returns to its upward position and the ball 126 is forced back against the orifice 124 to prevent the fluid from passing back up to the lower portion 105 of the second passage 104.

It can be readily seen, therefore, that the piston 120 pumps fluid to the control valve 70 regardless of the rotational direction of the input shaft 18 because the cam 112 reciprocates the pushrod 116 up and down in both forward and reverse speeds. Like the impeller pump 32, however, the volume of fluid flow from the cam piston pump assembly 110 varies proportionately with the speed of the drive gear 14. Therefore, the governor assembly 50 and the control valve 70 compensate for this variation as described above. Thus, by tuning the governor 50 and the control valve 70, a desired outflow of fluid from the pump 100 can be accomplished. Preferably, this outflow is substantially constant irrespective of the speed of the drive gear 14.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

I claim:

1. A fluid pump comprising a pump assembly generating a volume of fluid flow from a reservoir, said pump assembly being powered by an input drive; a control valve disposed between said pump assembly and an outflow, wherein said control valve alters a portion of said volume directed to said outflow when a speed of said input drive is changed; and a governor, wherein said governor alters a position of said control valve when said speed of said input drive is changed.

2. The fluid pump according to claim 1, further comprising a diversion, wherein said control valve alters a portion of said volume directed to said diversion in response to said portion directed to said outflow.

3. The fluid pump according to claim 2, further comprising an outflow passage extending through said control valve and a diversion passage extending through said control valve, said outflow passage being disposed to connect said pump assembly to said outflow and said diversion passage being disposed to connect said pump assembly to said diversion; wherein said control valve alters said outflow passage connection and said diversion passage connection thereby proportionately altering said portions directed to said outflow and said diversion.

4. The fluid pump according to claim 3, further comprising a pressure-regulating device disposed in said diversion.

5. The fluid pump according to claim 1, wherein said governor is a mechanical governor.

6. The fluid pump according to claim 5, wherein said portion of said volume directed to said outflow is substantially constant irrespective of said speed of said input drive.

7. The fluid pump according to claim 5, wherein said governor comprises swing arms pivotally attached to an input shaft of said input drive, wherein centrifugal force influences said swing arms when said speed of said input drive is changed thereby altering said position of said control valve.

8. The fluid pump according to claim 7, further comprising a spring biasing against said centrifugal force.

9. The fluid pump according to claim 8, wherein said swing arms are further pivotally attached to a rotating sleeve, said sleeve being engaged by a non-rotating drive member connected to said control valve.

10. The fluid pump according to claim 9, wherein said sleeve includes a slot and said drive member is disposed within said slot; and wherein said drive member is pivotally connected to a lever, said lever being pivotally connected to a housing and pivotally connected to a pushrod, said pushrod being pivotally connected to said control valve.

11. The fluid pump according to claim 3, wherein said input drive comprises a drive gear from a drivetrain component, said drive gear being enmeshed with a driven gear fixedly attached to an input shaft, said input shaft thereby rotatably powering said pump.

12. The fluid pump according to claim 3, wherein said pump assembly generates said volume of fluid flow regardless of a rotational direction of said drive input.

13. A fluid pump comprising a pump assembly generating a volume of fluid flow from a reservoir, said pump assembly being powered by an input drive; and a control valve disposed between said pump assembly and an outflow;

said control valve alters a portion of said volume directed to said outflow when a speed of said input drive is changed;

a diversion, said control valve alters a portion of said volume directed to said diversion in response to said portion directed to said outflow;

an outflow passage extending through said control valve and a diversion passage extending through said control valve, said outflow passage being disposed to connect said pump assembly to said outflow and said diversion passage being disposed to connect said pump to said diversion; wherein said control valve alters said outflow passage connection and said diversion passage connection thereby proportionately altering said portions directed to said outflow and said diversion;

said pump assembly generates said volume of fluid flow regardless of a rotational direction of said drive input; and said pump assembly is an impeller pump assembly.

14. The fluid pump according to claim 13, wherein said pump assembly comprises an impeller with a forward impeller section having blades facing one direction and a reverse impeller section having blades facing another direction, said forward impeller section substantially generating said volume of fluid flow when said input drive rotates one direction and said reverse impeller section substantially generating said volume of fluid flow when said input drive rotates in an opposite direction.

15. The fluid pump according to claim 14, wherein said input drive comprises an input shaft rotatably powering said pump assembly, said impeller being threadably attached to said input shaft; and wherein said impeller comprises a dividing plate extending out from an outer diameter of said impeller, said dividing plate thereby sealing one of said forward and reverse impeller sections when said input shaft rotates and thereby allowing the other impeller section to generate said volume of fluid flow.

16. The fluid pump according to claim 15, wherein said threadable attachment comprises a stop adapted to position said dividing plate near to but not touching a sealing surface when said input shaft rotates.

17. The fluid pump according to claim 16, wherein said pump assembly comprises a spring biasing said impeller toward a center of a pump cavity when said input drive is not rotating.

18. The fluid pump according to claim 17, wherein said pump assembly comprises axially opposing tapered roller bearings and seals mounted on said input shaft on opposite sides of said impeller, said bearings being disposed between said impeller and said seals.

19. A fluid pump comprising a pump assembly generating a volume of fluid flow from a reservoir, said pump assembly being powered by an input drive; and a control valve disposed between said pump assembly and an outflow;

said control valve alters a portion of said volume directed to said outflow when a speed of said input drive is changed;

a diversion, said control valve alters a portion of said volume directed to said diversion in response to paid portion directed to said outflow;

an outflow passage extending through said control valve and a diversion passage extending through said control valve, said outflow passage being disposed to connect said pump assembly to said outflow and said diversion passage being disposed to connect said pump to said diversion; wherein said control valve alters said outflow passage connection and said diversion passage connection thereby proportionately altering said portions directed to said outflow and said diversion; and a mechanical governor, said governor alters a position of said control valve when said speed of said input drive is changed; and wherein said pump assembly is an impeller pump assembly, said pump assembly generating said volume of fluid flow regardless of a rotational direction of said drive input, wherein said pump assembly comprises an impeller with a forward impeller section having blades facing one direction and a reverse impeller section having blades facing another direction, said forward impeller section substantially generating said volume of fluid flow when said input drive rotates one direction and said reverse impeller section substantially generating said volume of fluid flow when said input drive rotates in an opposite direction.

20. The fluid pump according to claim 19, wherein said input drive comprises an input shaft rotatably powering said pump assembly, said impeller being threadably attached to said input shaft; and wherein said impeller comprises a dividing plate extending out from an outer diameter of said impeller, said threadable attachment comprising a stop adapted to position said dividing plate near to but not touching a sealing surface when said input shaft rotates, said dividing plate thereby sealing one of said forward and reverse impeller sections when said input shaft rotates and thereby allowing the other impeller section to generate said volume of fluid flow.

21. The fluid pump according to claim 20, wherein said governor comprises swing arms pivotally attached to said input shaft of said input drive, wherein centrifugal force influences said swing arms when said speed of said input drive is changed thereby altering said position of said control valve, wherein a spring biases against said centrifugal force, said swing arms being further pivotally attached to a rotating sleeve, said sleeve being engaged by a non-rotating drive member connected to said control valve.

22. The fluid pump according to claim 21, wherein said portion of said volume directed to said outflow is substantially constant irrespective of said speed of said input drive.

23. The fluid pump according to claim 22, further comprising a pressure-regulating device disposed in said diversion.

24. The fluid pump according to claim 21, wherein said input drive comprises a drive gear from a drivetrain component, said drive gear being enmeshed with a driven gear fixedly attached to said input shaft, said input shaft thereby rotatably powering said pump.

25. A fluid pump comprising a pump assembly rotatably attached to an input shaft, said pump assembly generating a volume of fluid per unit time flow from a reservoir proportional to a rotational speed of said input shaft; and a governor altering the position of a control valve proportionately to said speed of said input shaft, said control valve directing a portion of said volume of fluid flow per unit time to an outflow and another portion to a diversion; wherein said outflow portion decreases as said speed of said input shaft increases.

26. The fluid pump according to claim 25, wherein said pump assembly generates said volume regardless of a rotational direction of said input shaft.

* * * * *